United States Patent [19]

Reinhardt

[11] Patent Number: 4,573,529

[45] Date of Patent: Mar. 4, 1986

[54] HIGH FLOW INJECTION ANCHOR

[75] Inventor: Paul A. Reinhardt, Houston, Tex.

[73] Assignee: Aker Oil Tools, Inc., Orange, Calif.

[21] Appl. No.: 588,451

[22] Filed: Mar. 12, 1984

[51] Int. Cl.[4] ..... E21B 43/12

[52] U.S. Cl. ..... 166/68; 166/105; 166/115; 166/129; 166/206; 166/237; 166/242

[58] Field of Search ..... 166/129, 68, 106, 206, 166/105, 115, 116, 242, 72, 90, 150, 149, 215, 237, 238

[56] References Cited

U.S. PATENT DOCUMENTS

| | | | |
|---|---|---|---|
| 1,273,663 | 7/1918 | Pierce | 166/106 |
| 2,760,578 | 8/1956 | Tausch | 166/115 |
| 2,795,281 | 6/1957 | Christian | 166/129 |
| 3,118,502 | 1/1964 | Cochran | 166/129 |
| 3,177,943 | 4/1965 | McCoy et al. | 166/68 |
| 3,313,350 | 4/1967 | Page, Jr. | 166/129 |
| 4,249,599 | 2/1981 | Krause | 166/72 |
| 4,271,903 | 6/1981 | Slagle, Jr. et al. | 166/129 |
| 4,273,186 | 6/1981 | Pearce et al. | 166/72 |

*Primary Examiner*—Stephen J. Novosad

*Assistant Examiner*—Hoang C. Dang

*Attorney, Agent, or Firm*—Norvell & Associates

[57] ABSTRACT

An anchor for a tubing string for use with a sucker rod pump is provided which defines a large fluid passage area for the passage of treatment fluids through the anchor. The anchor comprises a tubular body or body extensions having two vertically spaced sets of radial ports. A flow sleeve is positioned in straddling relationship across the bore of the anchor body and has its external surface recessed to provide an annular passage connecting the two sets of radial flow ports. The upper set of flow ports are connected to a tubular flow line extending to the well surface while the lower set of flow ports are connected tubular flow line extending to the production zone or to the location where corrosion, scale or other treatment becomes necessary. The flow sleeve is run into the well with a sucker rod pump on the sucker rod string and can be detachably latched to the tubing string in overlapping sealing relationship to the radial flow ports. Upward movement of the sucker rod string will effect disengagement of the latched securement of the flow sleeve, permitting it to be removed from the well with the sucker rod pump.

12 Claims, 6 Drawing Figures

HIGH FLOW INJECTION ANCHOR

BACKGROUND OF THE INVENTION

1. FIELD OF THE INVENTION

The invention relates to an anchor for mounting a tubing string within a well conduit and concurrently providing a high flow area fluid passage through the anchor for well treatment fluids which is maintained separate from the bore of the tubing string and from the casing annulus surrounding the tubing string.

2. HISTORY OF THE PRIOR ART

In many subterranean wells, it is necessary to provide a conduit for conducting a well treatment fluid to the producing zone or to some other location within the well bore. Most such wells have one or more anchors, hangers or packing devices disposed along the depth of the well for anchoring a tubing string carrying a well pump or other tool on its lower extremities. It is desirable to insert as large a pump as is permitted by the internal diameter of the anchor supporting the tubing string. At the same time, when high volumes of treatment fluids are required for the particular producing formation of the well, it has heretofore been necessary to decrease the internal bore of the anchor to accommodate the fluid conduit or conduits carrying such treatment fluid, hence reducing the effective diameter of the pump which can be inserted down through the tubing string and anchor to a position within the producing zone.

The problem is particularly acute in connection with wells which utilize a sucker rod pump to achieve the lifting of the produced fluid to the surface. As is customary, such sucker rod pump is seated on a pump seat provided at the bottom end of a tubing string. The tubing string is secured by a tubing anchor to the casing bore so that the pump is disposed adjacent the casing perforations, hence adjacent to the production zone of the well. The pumping capacity of sucker rod pumps is extremely sensitive to any reduction in maximum diameter of the pump and it is therefore desirable that the pump diameter be the maximum permitted for passage through the bore of the tubing string. The prior art has not provided an anchor device capable of anchoring such a tubing string without effecting a reduction in diameter of the tubing string when a large flow volume of well treatment fluid must also be conducted through the anchor to the production zone.

SUMMARY OF THE INVENTION

The present invention provides a tubing string anchor having a tubular body which is sealingly connectable in the tubing string and defines an internal bore of substantially the same diameter as the tubing string. Conventionally actuated slip elements are provided on the exterior of the tubular body for radial displacement into gripping engagement with the adjacent bore wall of the casing. The tubular body or body extensions further defines a pair of axially spaced, radial ports. The upper one of the radial ports is connected to a first tubular flow line which extends to the well surface while the lower one of the radial ports is connected to a second tubular flow line or lines extending to the production zones. To provide a substantially increased passage area for treatment fluids, the fluid treatment passages may comprise a plurality of such upper and lower radial ports and a plurality of tubular flow lines respectively extending to the surface from the upper set of radial ports and to the vicinity of the production zone from the lower set of radial ports.

To define the fluid treatment passage through the anchor, a flow sleeve is carried into the well on the sucker rod string by which the sucker rod pump is lowered into position. The flow sleeve can be secured to or located on the tubular string. In the preferred embodiment, the flow sleeve is provided with collet-type latching elements at both its upper and lower ends and these elements snap into latching engagement with appropriate grooves provided in the tubular string or in the inner surface of the tubular body of the anchor. A pair of external annular seals are provided on the flow sleeve and, in its latched position, such sleeves respectively lie above the upper ring of radial ports and below the lower ring of radial ports. One or more axially extending fluid passages are provided on the periphery of the sleeve and, in a preferred embodiment, the entire periphery is recessed so that an annular fluid passage is provided between the upper ring of radial ports and the lower ring of radial ports, thus assuring a maximum flow area for passage of the treatment fluid through the anchor.

In the preferred embodiment, the sleeve is shear pinned to a carrying element on the sucker rod string and is released from the sucker rod string through the application of an axial force to the sucker rod string, after one of the latching elements is engaged with the tubular string. The sucker rod string is thus freed to be moved downwardly to position the sucker rod pump in engagement with the conventional pump seat provided at the bottom of the tubing string. Additionally, the sleeve carrying element secured to the sucker rod string is thus moved downwardly below the lowermost latching elements of the valve sleeve so that the vertical reciprocating movements of the sucker rod string in operating the sucker rod pump does not produce any interference with the latching elements.

The flow sleeve may be readily removed from latched engagement with the anchor. In the preferred embodiment, removal occurs through the cooperation of camming surfaces respectively provided on the lowermost collet-type latch and the sleeve carrying element fixedly mounted on a sucker rod string. Upward movement of the sucker rod string will thus disengage the lowermost latching collet from the tubing string and apply an upward force to the sleeve, which effects the disengagement of the upper latching collet element carried by the sleeve. Thus, the entire flow sleeve unit, together with the rod pump, may be conventionally removed from the well for maintenance or replacement purposes.

Further advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1A:
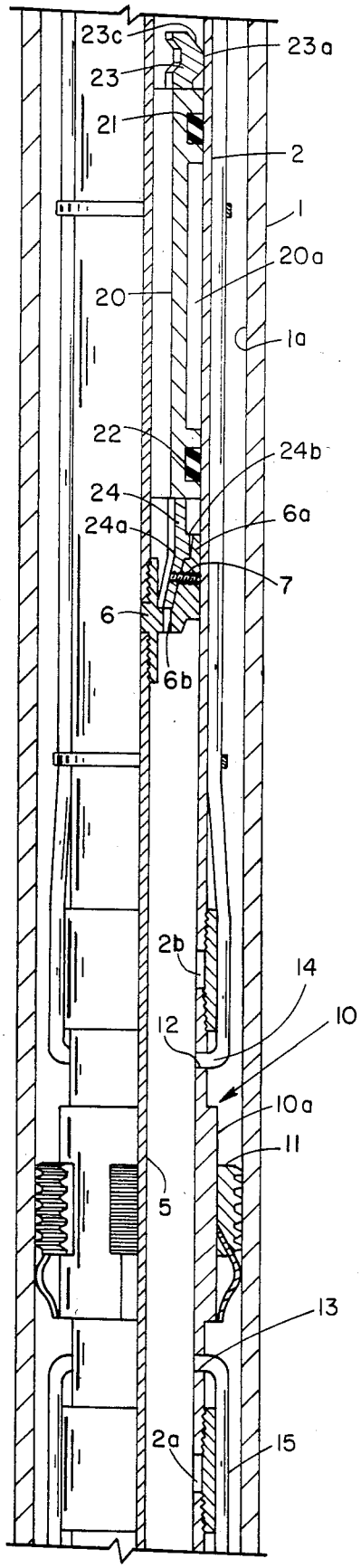
FIGS. 1A and 1B collectively constitute a vertical, sectional view of a well, including a tubing string and anchor, incorporating this invention, with a rod pump and flow sleeve positioned above their operative positions.
Figure 1B:
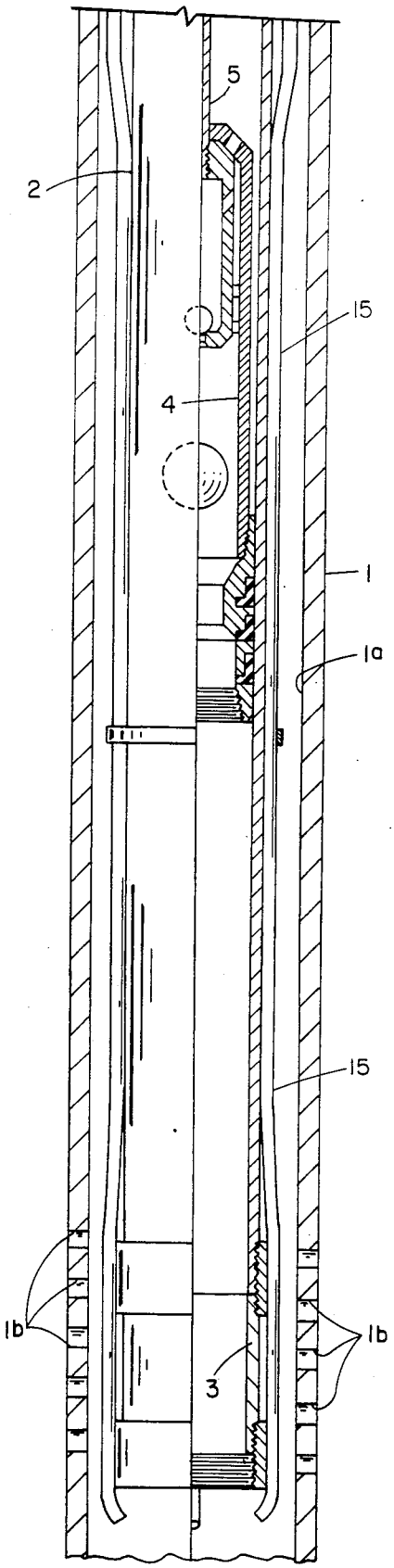
Figure 2A:
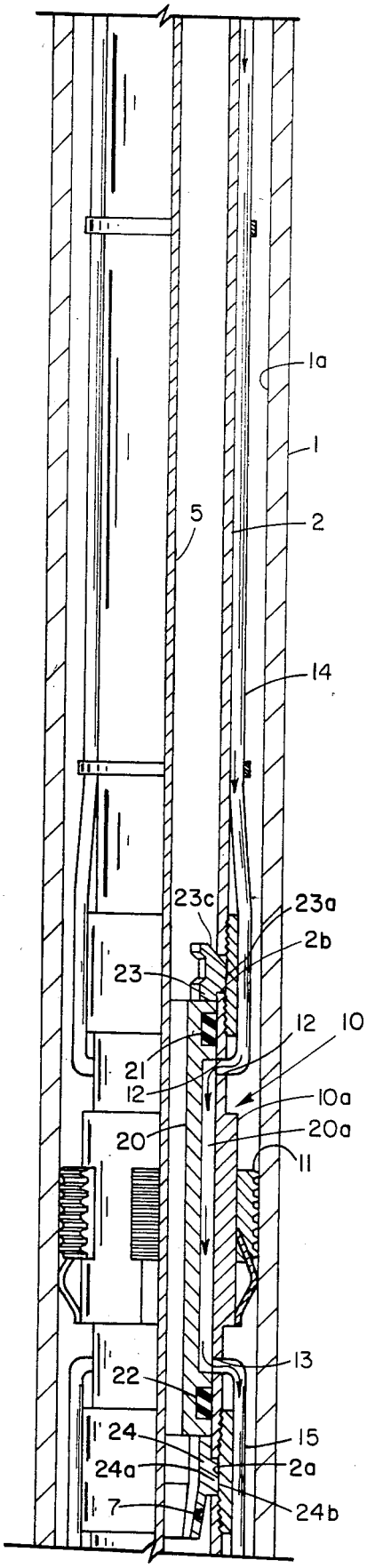
FIGS. 2A and 2B constitute views respectively similar to FIGS. 1A and 1B but showing the rod pump and flow sleeve in their operative positions with respect to the anchor, and with the pump operating to pump fluid up the tubing string.
Figure 2B:
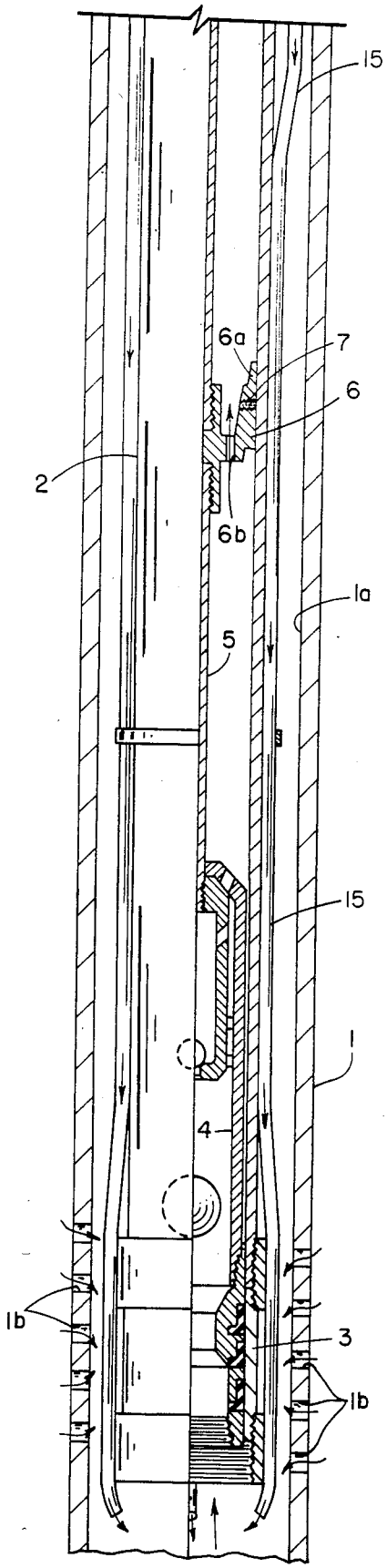

Referring to FIGS. 1A and 1B, there is shown a well casing 1 having a bore 1*a* which is provided with a plurality of perforations 1*b* adjacent to a production zone. A tubing string 2 comprising a plurality of threadably interconnected conventional piping elements is positioned within the casing bore 1*a* and is secured therein by an anchor 10 embodying this invention and having a plurality of peripherally spaced conventional slips 11 engaging the casing bore wall 1*a*.

The tubing string 2 is provided at its lower end with a conventional seat 3 for mounting thereon in sealing relationship a conventional sucker rod type pump 4. The seat 3, as is customary, is positioned adjacent the casing perforations 1*b*.

The sucker rod pump 4 is carried into the well in conventional fashion by a sucker rod string 5. At a point vertically spaced above the pump 4 by a distance greater than the stroke of the sucker rod string, an annular flow sleeve mounting element 6 is threadably secured in the sucker rod string. A flow sleeve 20 is secured to mounting element 6 in a manner to be described. The flow sleeve 20 cooperates with the anchor 10 in a manner to be hereinafter described in detail, to provide a large flow area fluid passage through the anchor for well treatment fluids.

Anchor 10 comprises a tubular body having two sets of radial ports 12 and 13 respectively disposed above and below the conventional external slips 11. The uppermost set of radial ports 12 are connected by individual tubular flow lines, pipes or conduits 14 which extend to the well surface through the casing annulus. Typical flow lines can consist of a tubular line such as would normally be used for control lines. Such injection completions have been referred to as control line completions. The lowermost set of ports 13 are similarly respectively connected to tubular flow lines, pipes or conduits 15 which extend downwardly along the exterior of the tubing string 2 to a position adjacent the casing perforations 1*b*, hence adjacent to the producing zone.

In accordance with this invention, the tubular flow lines, fluid conduits or pipes 14 and 15 are employed to inject appropriate treatment fluids into the producing zone. Such treatment fluid could be a chemical solution, fresh water, a salt water solution or a light solvent to dilute high gravity produced oil to facilitate the pumping thereof.

In accordance with this invention, the upper set of ports 12 are interconnected with the lower set of radial ports 13 through the positioning of a flow sleeve 20 in sealing relationship with the bore of the anchor body 10*a* and with two external seals straddling the upper and lower sets of radial ports 12 and 13. Thus, flow sleeve 20 is provided with a pair of axially spaced, external seals 21 and 22 which are respectively positioned above the upper radial ports 12 and below the lower radial ports 13. Longitudinally extending flow passages 20*a* are provided along the exterior of the flow sleeve 20. Preferably, such flow passage comprises an annular recess extending peripherally around the entire flow sleeve and thus defining a maximum area flow passage for the treatment fluids to flow through the anchor 10.

The flow sleeve 20 is positioned in the aforedescribed sealing relationship with respect to the radial ports 13 and 14 by being run into the well on the flow sleeve support 6 to which it is shearably connected. Other means could, of course, be employed. Thus, the flow sleeve 20 is provided with a lower latching collet portion 24 having downwardly projecting latching arms 24*a* which are shearably connected by a shear pin 7 to an annular upstanding ridge 6*a* provided on the flow sleeve support 6. The collet arms 24*a* are further provided with outwardly projecting latching surfaces 24*b* which engage in a suitable annular recess 2*a* provided in either the tubing string 2 or the anchor body 10*a*. In the illustrated example, the recesses 2*a* and 2*b* are formed intermediate the threaded connections of the anchor body 10*a* and the adjacent ends of the tubing string 2. The collet arms 24*a* are, however, held in a retracted position until shearing of the shear pin 7.

The upper end of the flow sleeve 20 is provided with upwardly projecting collet arms 23 with each arm having a radial locking projection 23*a* engagable in an annular recess 2*b* provided between the tubing string 2 and the upper end of the tubular body portion 10*a* of the anchor 10. The radial locking projections 23*a* are shaped so as to freely ride over small recesses or obstructions encountered in the tubing string wall during the run-in of the flow sleeve 20 on the sucker rod string 5. When, however, the collet is positioned opposite the large annular latching recess 2*b*, the collet arms 23 swing outwardly and lockingly engage in the annular recess 2*b*. In the illustrated example, a downward force then applied to sucker rod string 5 effects the shearing of shear pin 7, thus releasing collet arms 24*a* and engaging the locking projections 24*b* with the annular recess 2*a*. It will, of course, be understood that other latching mechanisms, such as a J-slot and J-pin configuration actuated by partial tubing rotation, could be substituted for the collet.

In this manner, the flow sleeve 20 is securely fastened in sealed, straddling relationship with respect to the upper radial ports 12 and the lower radial ports 13, and an isolated, large area fluid passage is provided for the application of treatment fluid from the well surface downwardly through the pipes 14, down through the annular recess 20*a* provided on the flow sleeve 20, and thence downwardly to the production zone through the pipes 15. Thus, the injection of a suitable treatment fluid may be accomplished without interfering in any manner with the operation of the pump 4 which receives production fluid through the perforations 1*b* into the open bottom end of the tubing string 2 and thence moves upwardly into the sucker pump 4 to move to the surface through the tubular string 2. For this purpose, the annular sleeve mounting element 6 is provided with one or more axially extending fluid passages 6*b*.

Figure 3A:
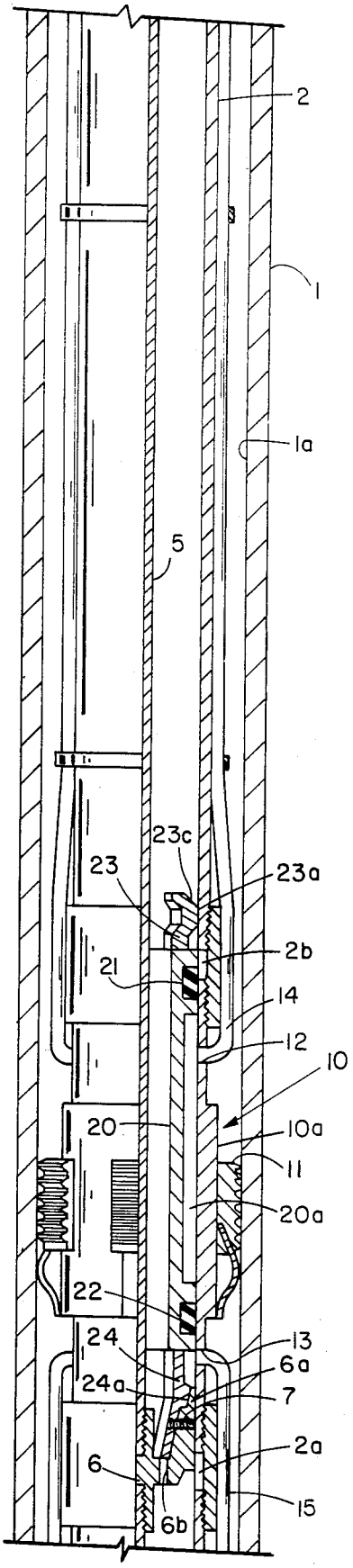
FIGS. 3A and 3B are views respectively similar to FIGS. 1A and 1B but showing the retrieval of the rod pump and the flow sleeve from their operative positions in the tubing string.
Figure 3B:
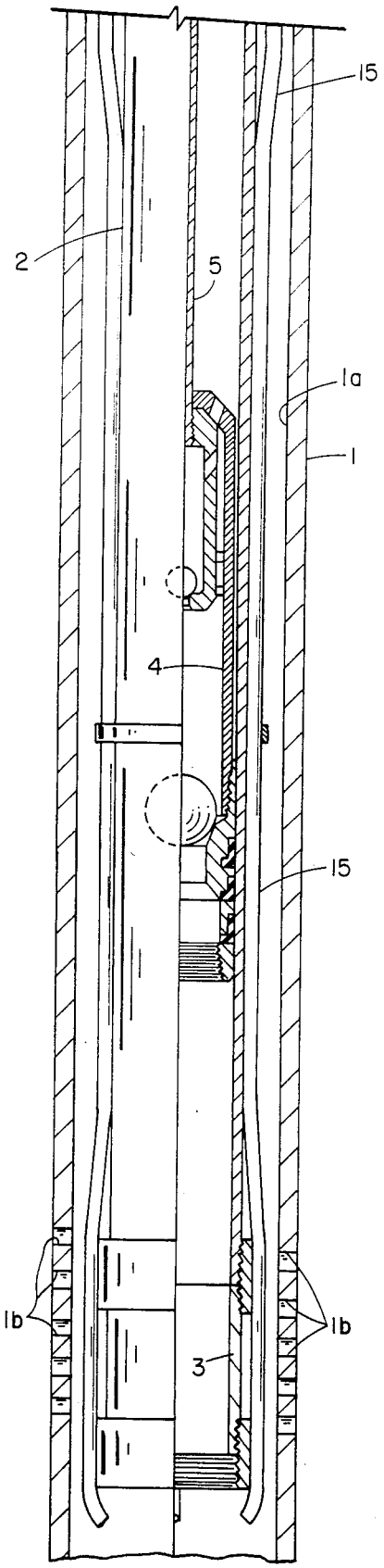

If, for any reason, it is desired to remove the sucker pump 4, such is readily accomplished through the simple expedient of withdrawing the sucker rod string 5. Upward movement of the sucker rod string 5 will disengage the pump 4 from its seat 3 and will bring the flow sleeve support element 6 into engagement with the lower ends of the lower latching collet 24. Cooperating cam surfaces on the upstanding ridge 6*a* of the sleeve support element 6 and the collet arms 24*a* effect the inward retraction of such arms to disengage such from the annular recess 2a. The upper latching collet 23 has an angular cam surface 23c formed on the upper end of the latching arms 23a and these arms cam out of the annular recess 2b through the application of an upward force to the flow sleeve 20. Thus, as shown in FIGS. 3A and 3B, the latching engagement of the flow sleeve 20 with the tubular string 2 can be disengaged through the simple elevation of the sucker rod string 5 to remove the pump and the flow sleeve from the well for repair or replacement purposes. Obviously, the flow sleeve 20 may be used again when it is desired to reinsert the pump into the well through the simple expedient of replacing the shear pin 7 between the flow sleeve support element 6 and the lower end of latching collet arms 24a.

From the foregoing description, it is obvious that the diameter of the pump 4 may be selected to be as large as is capable of insertion through the bore of the tubing string 2. In particular, the diameter of the pump 4 may be substantially greater than the internal bore diameter of the flow sleeve 20, since it is never required that the pump 4 pass through the flow sleeve 20. Thus, the best of all worlds is achieved because a large diameter pump may be utilized, while at the same time, a fluid passage for injection of well treatment fluids into the producing zone is provided which is of substantial cross-sectional area and yet is isolated from both the interior of the tubular string 2 and the casing annulus.

Although the invention has been described in terms of a specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for anchoring a tubing string in a subterranean well casing and concurrently providing an axially extending fluid passage through the anchor which is isolated from both the tubing bore and the casing annulus comprising, in combination, an anchor having a tubular body sealingly connectable in the tubing string; slip means on the exterior of said tubular body engagable with the casing bore, a pair of axially spaced radially extending port means in said tubular body or body extensions, the upper one of said radial port means being connectable to first conduit means extending to the surface, the lower one of said radial port means being connectable to second conduit means extending therebelow; a sucker rod string insertable through the tubing string to support a rod-type pump adjacent the production zone; a sleeve surrounding and attached to said string and carrying two external seals respectively positionable above said upper radially extending port and below said lower radially extending port; said sleeve having an axially extending recess on its outer surface intermediate said two external seals, thereby providing a fluid connection between said radial ports; and releasable latch means on said sleeve for releasably positioning said sleeve in sealing, straddling relationship to said radial ports.

2. The apparatus of claim 1 wherein said rod-type pump has a diameter in excess of the bore diameter of said sleeve.

3. The apparatus of claim 1 wherein said axially extending fluid passage is defined by an annular recess formed on the exterior of said sleeve.

4. The apparatus of claim 1 wherein each said radial port means includes a plurality of peripherally spaced radial ports; and said first and second conduit means each comprise a plurality of tubular flow lines repectively connected to said radial ports.

5. The apparatus of claim 4 wherein said rod-type pump has a diameter in excess of the bore diameter of said sleeve.

6. The apparatus of claim 4 wherein said axially extending fluid passage is defined by an annular recess formed on the exterior of said sleeve.

7. In a rod pumping apparatus for an encased subterranean well having a tubular production string extending from the surface to a production zone; a pump seat supported by the tubular production string adjacent the production zone, and a rod pump insertable in the tubing string on a sucker rod string to seat on the pump seat; the improvement comprising an anchor sealingly insertable in the production tubing string at a position above the pump seat; said anchor having a tubular body defining a bore substantially equal in diameter to the production tubing string bore; slip means on the periphery of said tubular body for gripping engagement with the casing bore; thereby supporting the production tubing string; a pair of axially spaced radial port means in said tubular body, the upper one of said radial port means being connectable to first conduit means extending to the surface, the lower one of said radial port means being connected to second conduit means extending to the production zone; a sleeve surrounding and attached to said sucker rod string, latching means for positioning said sleeve in an overlying position to both said radial port means; a pair of axially spaced seals on the exterior of said sleeve engagable with said bore of said tubular body respectively above and below said radial port means; and an axially extending fluid channel on the exterior of said sleeve interconnecting said radially spaced port means, whereby well treatment fluid can be supplied to the production zone without entry into the production tubing string or into the casing annulus.

8. The apparatus of claim 7 wherein the internal diameter of said sleeve is less than the external diameter of the rod pump.

9. The apparatus of claim 7 wherein said axially extending fluid channel is defined by an annular recess formed on the exterior of said sleeve.

10. The apparatus defined in claim 7 wherein said latching means comprises a first latching collet secured to one end of said sleeve; a restraining member secured to the sucker rod string and attached to the latching collet to maintain said first latching collet in an operative position; and a second latching collet secured to the other end of said sleeve and engagable with the tubing string at said overlapping position, thereby permitting an axial force applied to said rod string to shear the shear-pin connection between said first latching collect and said restraining member to release said first latching collet to engage the tubing string and permit axial movements of said sucker rod string relative to said anchor.

11. The apparatus defined in claim 10 wherein said restraining member has an annular cam surface engagable with said first latching collet to retract same by upward removal movement of said rod string.

12. The apparatus of claim 11 wherein said annular restraining member has an axially extending fluid passage to accommodate flow of fluid pumped by said rod pump.

* * * * *

UNITED STATES PATENT AND TRADEMARK OFFICE

CERTIFICATE OF CORRECTION

PATENT NO. : 4,573,529

DATED : March 4, 1986

INVENTOR(S) : Paul A. Reinhardt

It is certified that error appears in the above-identified patent and that said Letters Patent is hereby corrected as shown below:

On the title page, Item [73] Assignee:, delete "Aker Oil Tools, Inc.", and substitute --Baker Oil Tools, Inc.--.

Signed and Sealed this

*Twenty-fourth* Day of *June 1986*

[SEAL]

*Attest:*

DONALD J. QUIGG

*Attesting Officer*

*Commissioner of Patents and Trademarks*